US009153912B2

(12) United States Patent
Boyden et al.

(10) Patent No.: US 9,153,912 B2
(45) Date of Patent: Oct. 6, 2015

(54) CONNECTOR BACKSHELL FOR SHIELDED CONDUCTORS

(71) Applicant: Honeywell International Inc., Morristown, NJ (US)

(72) Inventors: Christopher Boyden, Albuquerque, NM (US); Harold Brian Robinson, Albuquerque, NM (US); John Geruntho, Rio Rancho, NM (US)

(73) Assignee: Honeywell International Inc., Morristown, NJ (US)

( * ) Notice: Subject to any disclaimer, the term of this patent is extended or adjusted under 35 U.S.C. 154(b) by 46 days.

(21) Appl. No.: 14/188,237

(22) Filed: Feb. 24, 2014

(65) Prior Publication Data

US 2015/0244112 A1 Aug. 27, 2015

(51) Int. Cl.

| | |
|---|---|
| ***H01R 13/648*** | (2006.01) |
| ***H01R 13/6588*** | (2011.01) |
| ***H01R 13/6461*** | (2011.01) |
| ***H01R 13/6591*** | (2011.01) |

(52) U.S. Cl.

CPC ..... *H01R 13/6588* (2013.01); *H01R 13/6461* (2013.01); *H01R 13/6591* (2013.01)

(58) Field of Classification Search

CPC ..... H01R 13/65802; H01R 23/688
USPC ..... 439/607.01, 607.04, 101, 108, 465–469
See application file for complete search history.

(56) References Cited

U.S. PATENT DOCUMENTS

| | | | | |
|---|---|---|---|---|
| 4,820,201 | A | 4/1989 | Van Brunt et al. | |
| 5,118,306 | A | 6/1992 | Bixler et al. | |
| 5,170,008 | A | 12/1992 | Evans et al. | |
| 5,387,130 | A | 2/1995 | Fedder et al. | |
| 6,354,879 | B1 | 3/2002 | Plehaty | |
| 7,052,323 | B1 | 5/2006 | Ruff et al. | |
| 7,892,045 | B2 | 2/2011 | Ratzlaff et al. | |
| 8,002,572 | B2 * | 8/2011 | Lu et al. | 439/405 |
| 8,142,226 | B2 * | 3/2012 | Xiao et al. | 439/607.56 |
| 8,388,378 | B2 | 3/2013 | Ratzlaff et al. | |
| 2010/0317220 | A1 * | 12/2010 | Shen | 439/374 |
| 2011/0312217 | A1 * | 12/2011 | Xiao et al. | 439/607.23 |

OTHER PUBLICATIONS

Bradley et al., "Bulk Current Injection Testing of Cable Noise Reduction Techniques, 50 kHz to 400 MHz", "2009 IEEE International Symposium on Electromagnetic Compatibility", Aug. 17-21, 2009, pp. 1-6.

(Continued)

*Primary Examiner* — Phuongchi T Nguyen

(74) *Attorney, Agent, or Firm* — Fogg & Powers LLC

(57) ABSTRACT

A connector backshell assembly comprises a first cover, a second cover, a first sidewall block between the first cover and the second cover, and a second sidewall block between the first cover and the second cover, with the second sidewall block spaced apart from and facing the first sidewall block. At least one shield termination structure is located between the first and second covers, with the shield termination structure including a plurality of slots that are substantially parallel to each other. The first and second covers, and the first and second sidewall blocks, define a front opening in communication with the slots. Each of the slots are configured to hold a conductor that extends from a rear portion of the backshell assembly into the front opening for termination connection with an electrical connector. The backshell assembly is electrically conductive and provides a shield to prevent electromagnetic interference with each conductor.

20 Claims, 14 Drawing Sheets

(56) References Cited

OTHER PUBLICATIONS

Bradley et al., "Effectiveness of Shield Termination Techniques Tested with TEM Cell and Bulk Current Injection", "2009 IEEE International Symposium on Electromagnetic Compatibility", Aug. 17-21, 2009, pp. 1-6.

"What Is Starshield Zero Length Shield Termination?"Publisher: Glenair, Inc.

* cited by examiner

CONNECTOR BACKSHELL FOR SHIELDED CONDUCTORS

BACKGROUND

Typical connector backshell and connector systems rely on "pigtails" or drain-wires in order to terminate the shields to the conductive chassis or parts of the chassis of an electronic device. The pigtails and/or drain-wires are a compromise to a proper shield termination.

Although widely prevalent throughout the electronics industry, the pigtail and/or drain wire shield termination is not ideal. Pigtail shields concentrate currents on one side of the shield, leaving the other side unshielded. In addition, pigtail terminations can significantly couple noise into the cable system by virtue of the standing antennas formed by the pigtail.

SUMMARY

A connector backshell assembly comprises a first cover, a second cover spaced apart from the first cover, a first sidewall block between the first cover and the second cover, and a second sidewall block between the first cover and the second cover, with the second sidewall block spaced apart from and facing the first sidewall block. At least one shield termination structure is located between the first cover and the second cover, with the shield termination structure including a plurality of slots that are substantially parallel to each other. The first and second covers, and the first and second sidewall blocks, define a front opening in communication with the slots of the shield termination structure. Each of the slots in the shield termination structure are configured to hold a conductor that extends from a rear portion of the backshell assembly into the front opening for termination connection with an electrical connector. The backshell assembly is electrically conductive and provides a shield to prevent electromagnetic interference with each conductor.

BRIEF DESCRIPTION OF THE DRAWINGS

Features of the present invention will become apparent to those skilled in the art from the following description with reference to the drawings. Understanding that the drawings depict only typical embodiments and are not therefore to be considered limiting in scope, the invention will be described with additional specificity and detail through the use of the accompanying drawings, in which.

DETAILED DESCRIPTION

In the following detailed description, embodiments are described in sufficient detail to enable those skilled in the art to practice the invention. It is to be understood that other embodiments may be utilized without departing from the scope of the invention. The following detailed description is, therefore, not to be taken in a limiting sense.

A connector backshell is provided for termination connection of conductors, such as shielded conductors, to a conventional electrical connector. For example, the connector backshell can provide a low impedance, 360 degree termination connection of the conductors to an electrical connector, such as a D-subminiature or other low profile connector, a circular connector, or the like.

The connector backshell can be easily assembled, and allows for the shields in shielded conductors to be terminated without the use of pigtails or drain wires, reducing the number of steps needed in a shield termination process. This provides for a simpler and neater installation of the conductors, as well as a more effective electrical shield termination of the conductors, such as shielded cables, shielded twisted pairs, multiconductor cables, or the like.

The connector backshell assembly can be constructed in such a way that all sides are entirely shielded to prevent radiated susceptibility to radio frequency (RF) interference. The connector backshell assembly can also be configured to terminate a plurality of conductors in single a row or in multiple stacked rows as needed.

Further aspects of the connector backshell assembly are described hereafter with reference to the drawings.

Figure 1:
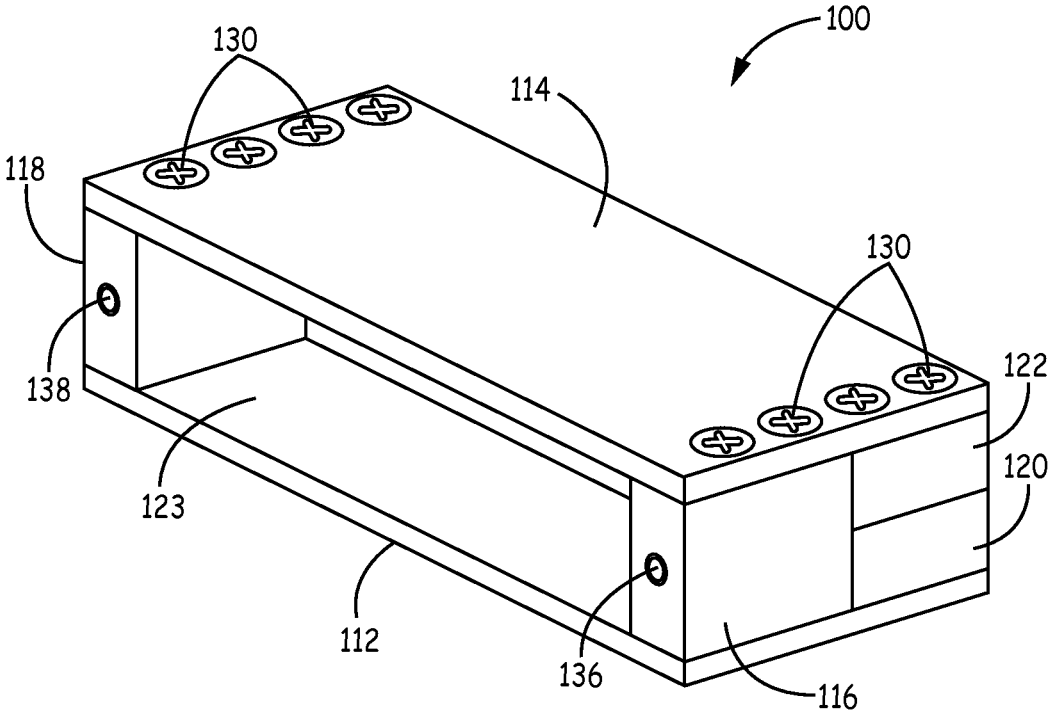
FIG. 1 is an assembled perspective view of a connector backshell assembly according to one embodiment.
Figure 2:
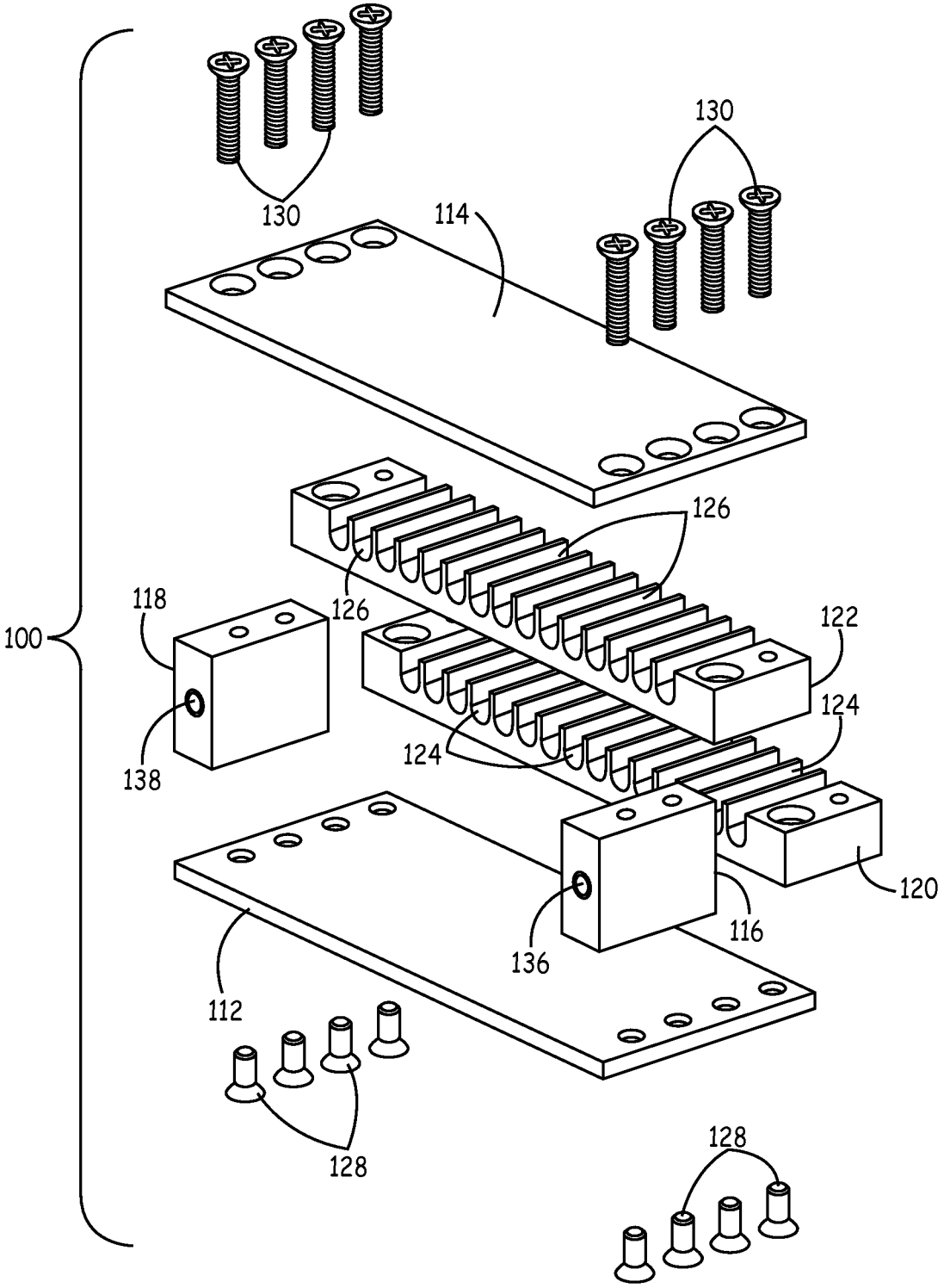
FIG. 2 is an exploded front perspective view of the connector backshell assembly of FIG. 1.

FIGS. 1 and 2 illustrate a connector backshell assembly 100 according to one embodiment. The backshell assembly 100 includes a first cover such as a bottom lid 112, and a second cover such as a top lid 114. A first sidewall block 116 is coupled at one end between bottom lid 112 and top lid 114. A second sidewall block 118 is coupled at an opposite end between bottom lid 112 and top lid 114. In one embodiment, bottom lid 112 and top lid 114 have substantially the same size and shape, such as a substantially rectangular shape, and the first and second sidewall blocks 116, 118, have substantially the same size and shape.

As shown in FIG. 1, connector backshell assembly 100 has an opening 123 defined by bottom lid 112, top lid 114, and sidewall blocks 116, 118. The opening 123 is adapted to receive a connector insert, which is described in further detail hereafter.

A pair of shield termination structures 120, 122 are located between bottom lid 112 and top lid 114, and behind sidewall blocks 116, 118, in a stacked configuration. As depicted in FIG. 2, shield termination structure 120 includes a plurality of slots 124 that are substantially parallel to each other. Likewise, shield termination structure 122 includes a plurality of slots 126 that are substantially parallel to each other and to slots 124. The slots 124 and 126 are configured to receive conductors from outside of backshell assembly 100 and to direct the conductors into opening 123. In one embodiment, slots 124 and 126 are a series of corrugated or serrated channels having a U-shaped cross section that form shield termination pockets. The channels have a sufficient length to effectively form a low impedance 360 degree encapsulation of the shield on the conductors.

While a pair of stacked shield termination structures 120, 122 are shown in FIGS. 1 and 2, it should be understood that other configurations can be implemented in other embodiments. For example, a single termination support structure, or a stack of three or more termination support structures can be implemented. In addition, the termination support structures can be constructed with more or less slots than shown as needed, by increasing or decreasing the length of the termination support structures along which the slots are located.

The bottom lid 112 can be attached to the bottoms of sidewall blocks 116, 118 and shield termination structure 120 with a plurality of fasteners 128. The top lid 114 can be attached to the top surfaces of sidewall blocks 116, 118 and shield termination structure 122 with a plurality of fasteners 130. While fasteners 128 and 130 can be removable screws or bolts, non-removable fasteners, such as rivets, welding, or the like, can alternatively be used. When assembled, all joints of backshell assembly 100 are electromagnetic interference (EMI) tight. A standard electrical connector can be attached to the front of backshell assembly 100 with fasteners inserted into a pair of front apertures 136, 138.

The components of the connector backshell assembly can be composed of various electrically conductive materials, such as metals, conductive composites, or plastics made conductive by metallic plating processes. In various embodiments, galvanically compatible materials can be used for the various components of the connector backshell assembly. The components of the backshell assembly can be made through various standard fabrication techniques, such as machining, casting, stamping, plastic molding, or composite processing. The conductors used with the backshell assembly can be matched to form maximum galvanic compatibility.

Figure 3:
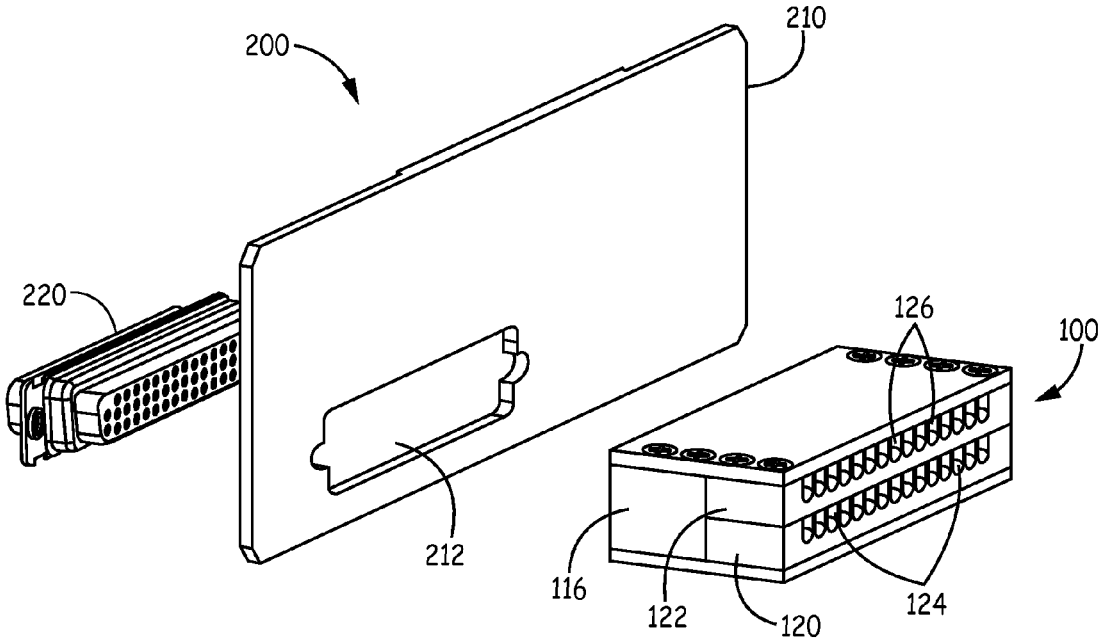
FIG. 3 is an exploded perspective view of a connector termination apparatus according to one embodiment, which includes the connector backshell assembly of FIG. 1.

As depicted in FIG. 3, connector backshell assembly 100 can be employed as part of a connector termination apparatus 200 according to one embodiment. The connector termination apparatus 200 also includes a rear face plate 210 for an electronic modular device, and a power/signal connector 220 such as a D-subminiature connector. The face plate 210 has an opening 212 through which connector backshell assembly 100 is coupled to connector 220.

Figure 4:
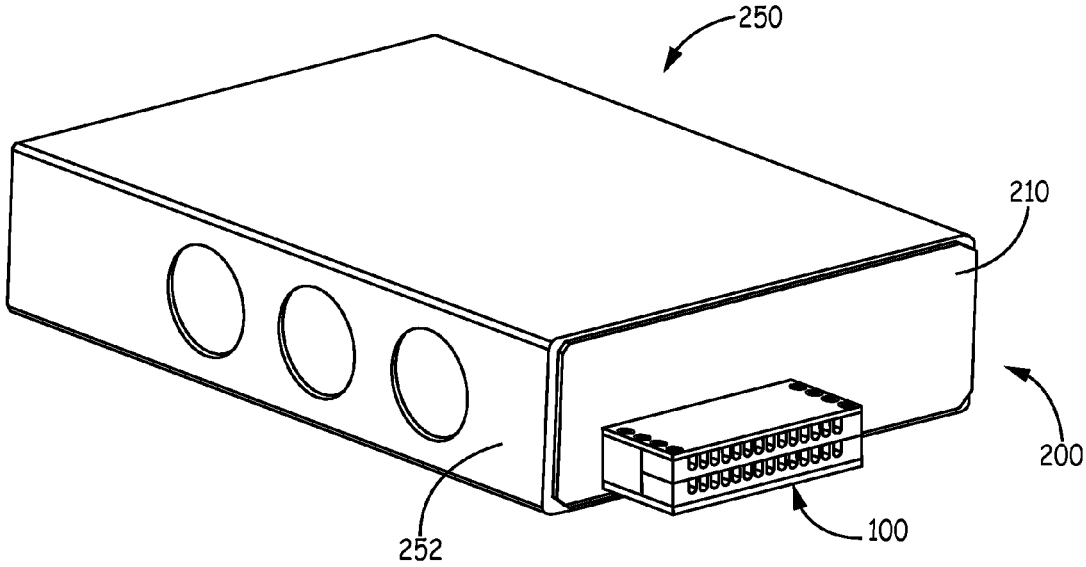
FIG. 4 is a perspective view of electronic modular device, which includes the connector termination apparatus of FIG. 3 according to one embodiment.

FIG. 4 illustrates an electronic modular device 250 according to one embodiment, which includes connector termination apparatus 200 according to one embodiment. The rear face plate 210 of connector termination apparatus 200 is coupled to a rear portion of a chassis 252 of electronic modular device 250. The connector termination apparatus 200 can be used to terminate conductors that are coupled to electronic modular device 250 through connector backshell assembly 100. In an exemplary embodiment, electronic modular device 250 can be mounted inside an aircraft and employed as part of the avionics equipment for the aircraft.

Figure 5A:
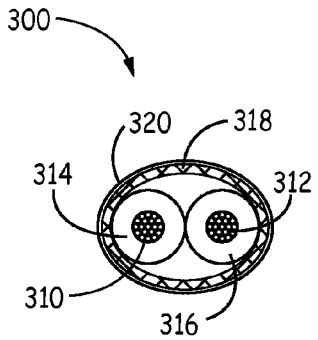
FIG. 5A is an end view of a conductor according to an exemplary embodiment that can be terminated using the connector backshell assembly of FIG. 1.

FIG. 5A is an end view of an exemplary embodiment of a shielded conductor 300, such as a shielded single twisted pair conductor, which can be terminated using the present connector backshell assembly. The conductor 300 includes a pair of wires 310 and 312 that are each surrounded by a respective insulation sheath 314 and 316. A shield 318, such as a braided metallic shield, surrounds insulation sheaths 314 and 316. An outer insulator jacket 320 surrounds shield 318. As shown in FIG. 5A, conductor 300 has a generally elliptical end view profile.

Figure 5B:
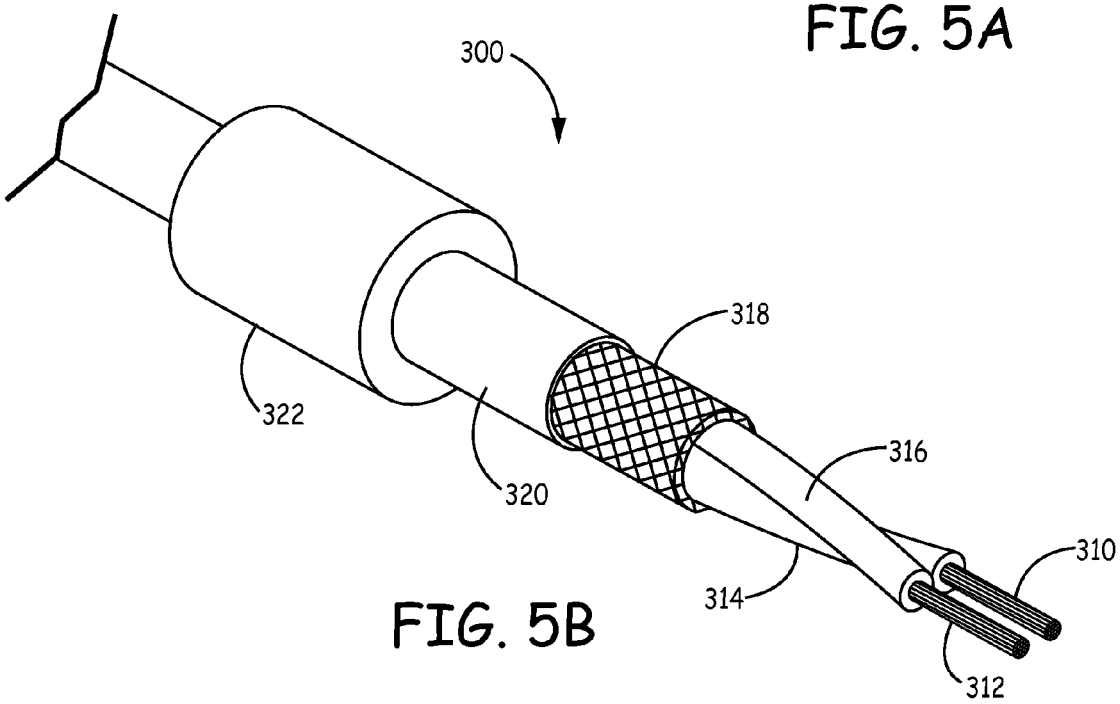
FIG. 5B is a perspective view of a conductor that has been prepared for termination with the connector backshell assembly of FIG. 1.

In preparing conductor 300 for termination with backshell assembly 100, a conductive grommet 322 is slid over a portion of outer insulator jacket 320, as depicted in FIG. 5B. The grommet 322 can be a preformed sleeve that is sized to snugly fit over outer insulator jacket 320, and can be made of an elastomeric material impregnated with conductive particles, such as silver, nickel, aluminum, or other conductive materials such as carbon.

Alternatively, a non-conductive grommet can be molded directly over an unshielded conductor when used. Such a molded grommet can be formed with a rubber epoxy material, for example.

A portion of outer insulator jacket 320 is removed, exposing an underlying portion of shield 318 between grommet 322 and the distal end of conductor 300. A portion of the exposed shield 318 is then removed, exposing underlying insulation sheaths 314 and 316 between the exposed portion of shield 318 and the distal end of conductor 300. Lastly, a portion of the exposed insulation sheaths 314 and 316 is removed, exposing wires 310 and 312.

Figure 6:
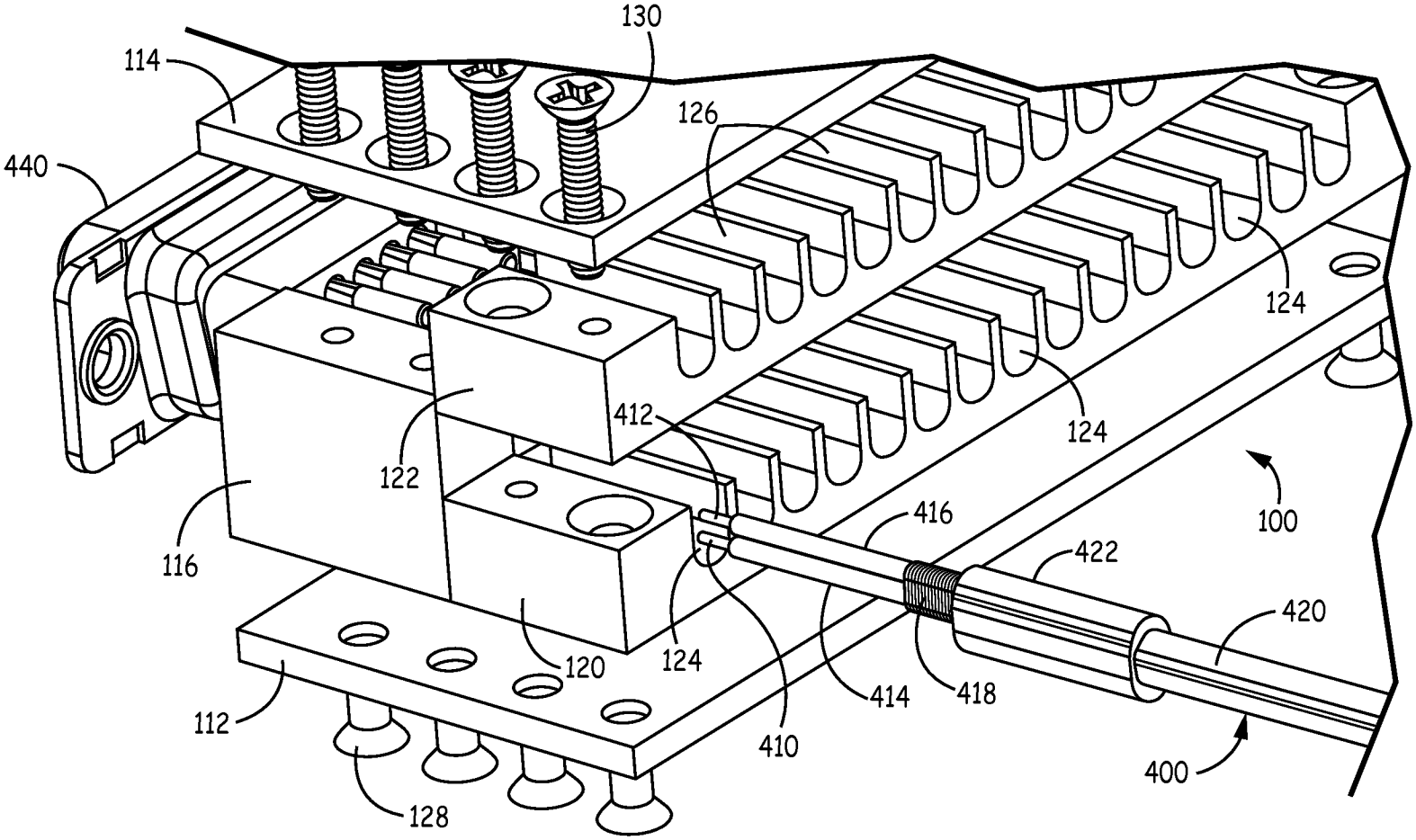
FIG. 6 is an exploded rear perspective view of the connector backshell assembly of FIG. 1, and including a conductor that has been prepared for termination with an electrical connector.

FIG. 6 is an exploded view of connector backshell assembly 100 and a shielded conductor 400 that has been prepared for termination with backshell assembly 100. The conductor 400 includes a pair of exposed wires 410 and 412, a pair of insulation sheaths 414 and 416 covering unexposed portions of the wires, a shield 418 that covers the unexposed portions of insulation sheaths 414 and 416, and an outer insulator jacket 420 that surrounds the unexposed portion of shield 418. A conductive grommet 422, composed of a conductive elastomeric material, is positioned on outer insulator jacket 420. The grommet 422 is sized to snugly fit within slot 124 of shield termination structure 120 when conductor 400 is inserted therein.

Figure 7:
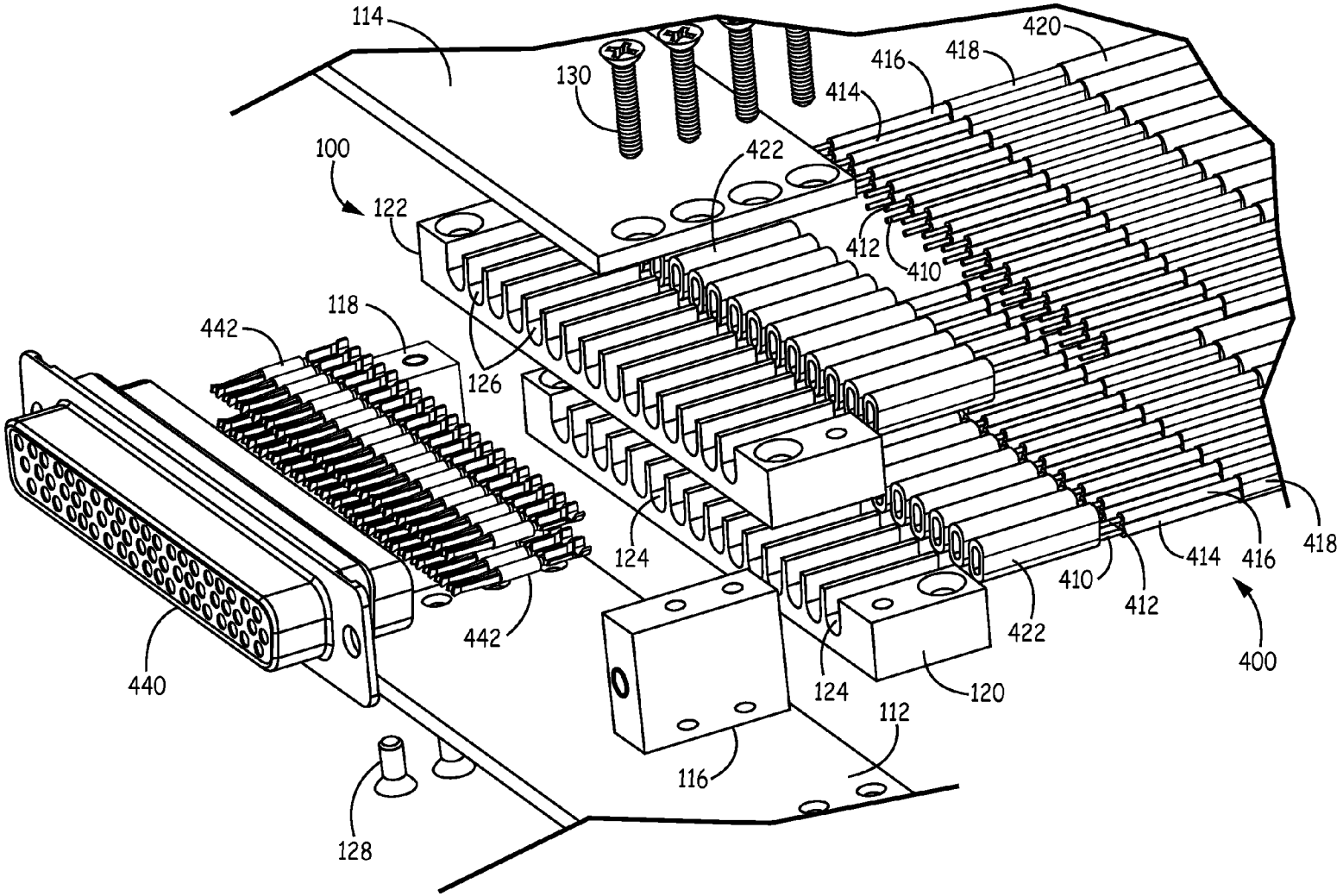
FIG. 7 is an exploded front perspective view of the connector backshell assembly of FIG. 1, including a plurality of conductors that have been prepared for termination with an electrical connector.

The conductor 400 can be terminated by coupling exposed wires 410 and 412 to a connector 440 that is attached to the front of backshell assembly 100. Any of slots 124, or slots 126 in shield termination structure 122, which remain empty after all conductors have been terminated, can be occupied with a solid filler piece sized to be inserted in slots 124 and 126 to prevent electromagnetic interference (EMI) leakage. The filler pieces can be made of the same conductive elastomeric material as grommet 422. FIG. 7 is a partial front perspective view of connector backshell assembly 100, and a plurality of shielded conductors 400 that have been prepared for termination with backshell assembly 100. Each of conductors 400 include a pair of exposed wires 410 and 412, a pair of insulation sheaths 414 and 416 covering unexposed portions of the wires, a shield 418 that covers the unexposed portions of insulation sheaths 414 and 416, and an outer insulator jacket 420 that surrounds the unexposed portion of shield 418. A plurality of conductive grommets 422 are positioned for insertion in slots 124 and 126 of shield termination structures 120 and 122.

Each of conductors 400 can be terminated by coupling exposed wires 410 and 412 to respective contact pins 442 of connector 440, such as by crimping the wires to the pins. The backshell assembly 100 provides for neat and orderly arrangement of all the cables and wires of conductors 400 due to the constrained arrangement of wire pairs in a row and column format that follows the pattern of slots 124 and 126.

Mechanical strain relief can also be provided to the wires by the clamping action of slots 124 and 126 on grommets 422 and the wires. The slots 124 and 126 can also accommodate strain relief of unshielded wire using non-conductive grommets.

Figure 8:
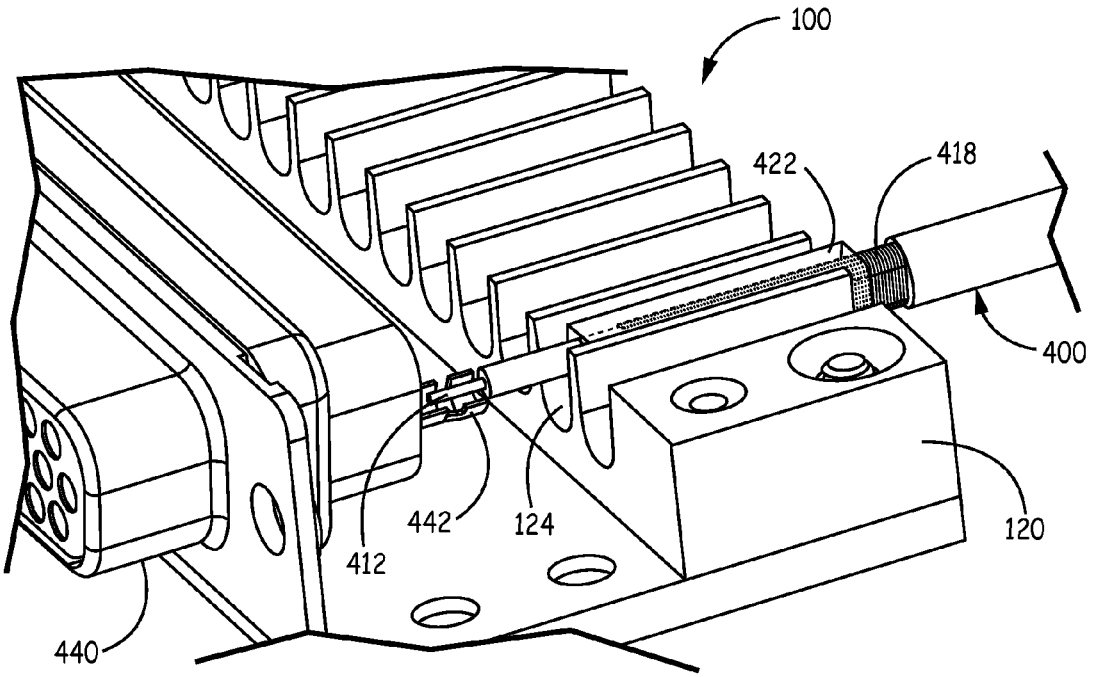
FIG. 8 is a partial perspective view of the connector backshell assembly of FIG. 1, including a conductor that is in the process of being terminated to an electrical connector.
Figure 9:
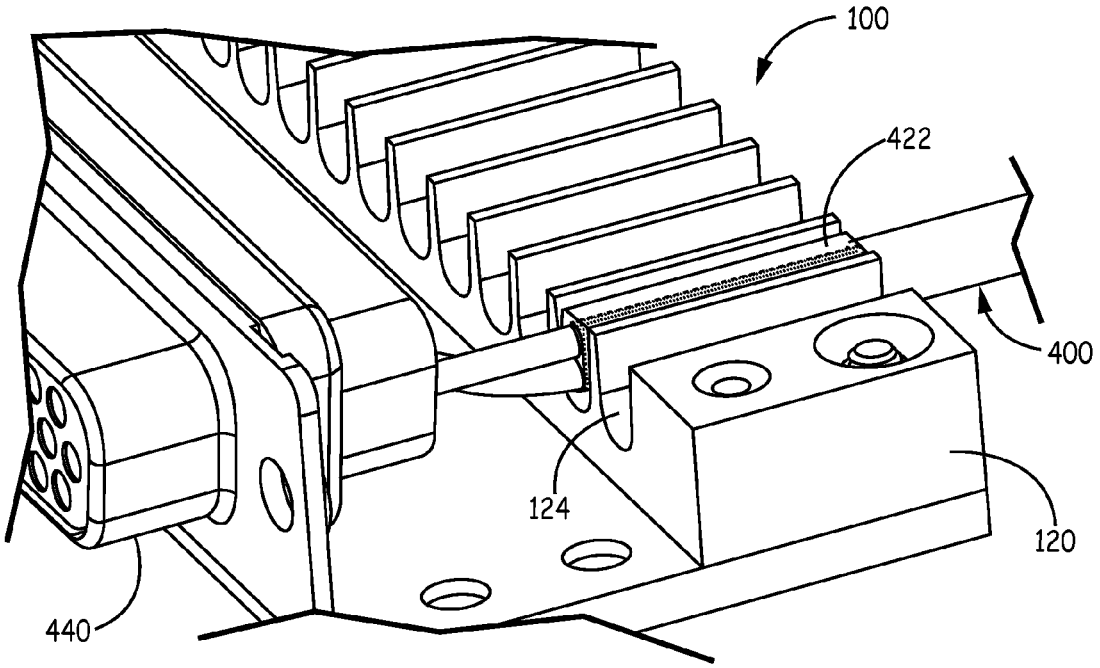
FIG. 9 is a partial perspective view of the connector backshell assembly of FIG. 1, including a conductor that has been terminated to an electrical connector.

FIGS. 8 and 9 illustrate further steps in the termination of a shielded conductor 400 in connector backshell assembly 100. Only one wire 412 of shielded conductor 400 is shown to simplify the view. As shown FIG. 8, conductor 400 is inserted through a slot 124 of shield termination structure 120. The conductor 400 is coupled to connector 440 by crimping wire 412 to a contact pin 442. At this point, shield 418 and conductive grommet 422 have only been partially inserted into slot 124. As depicted in FIG. 9, when both of the wires of conductor 400 have been coupled to connector 440, shield 418 and conductive grommet 422 are fully inserted into slot 124. This results in a 360 degree contact of shield 418 with grommet 422.

Figure 10:
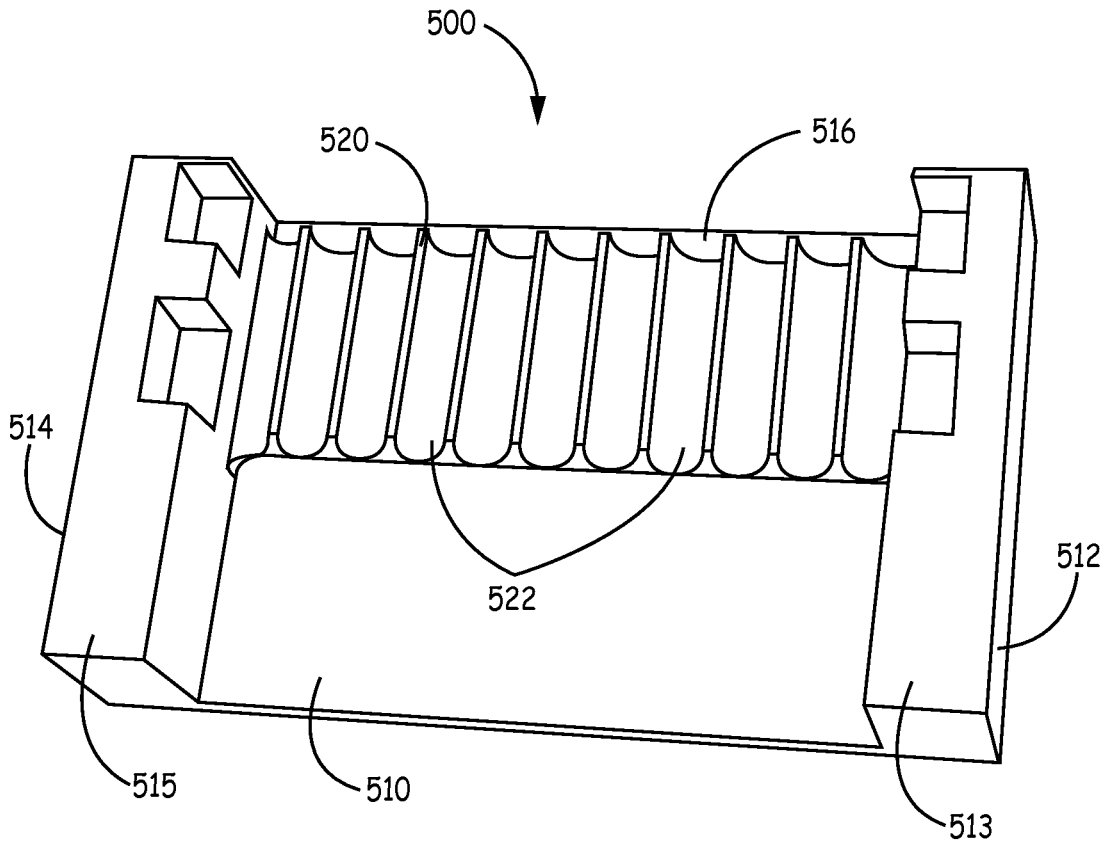
FIG. 10 illustrates a connector backshell according to an alternative embodiment.

FIG. 10 illustrates a backshell 500 according to an alternative embodiment, in which the components are integrally formed as a single unitary structure. The backshell 500 includes a base 510, a first sidewall block 512 on one end of base 510, and a second sidewall block 514 on an opposite end of base 510. A shield termination structure 520 is located between sidewall blocks 512 and 514 along a rear portion 516 of base 510. The shield termination structure 520 includes a plurality of slots 522 that are substantially parallel to each other and sidewall blocks 512, 514. The slots 522 are configured to receive conductors from outside of backshell 500 that are inserted at rear portion 516.

When the wires of the conductors have been coupled to a connector, as described for previous embodiments, the exposed shields of the conductors and corresponding conductive grommets around the shields can be fully inserted into slots 522. A top cover similar to lid 114 (FIG. 2) can be attached to a top surface 513 of sidewall block 512, and to a top surface 515 of sidewall block 514, to provide a completed connector backshell assembly.

The backshell 500 can be fabricated as a single unitary structure by standard techniques, such as machining, casting, stamping, plastic molding, or composite processing. The backshell 500 can be composed of various conductive materials, including metals, as well as composites or plastics made conductive by metallic plating processes.

Figure 11:
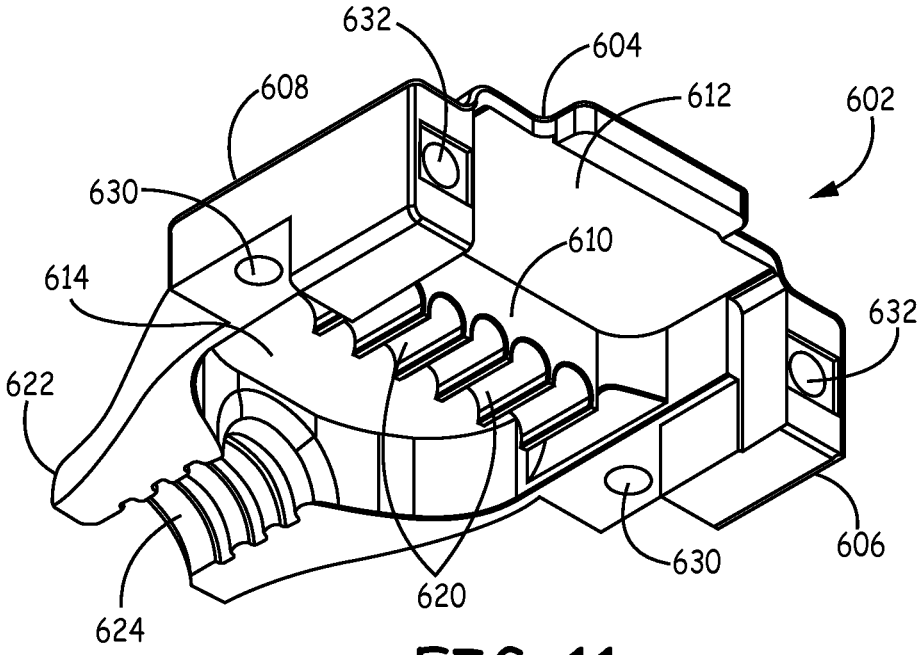
FIGS. 11-13 illustrate the components of a connector backshell assembly according to another embodiment.
Figure 12:
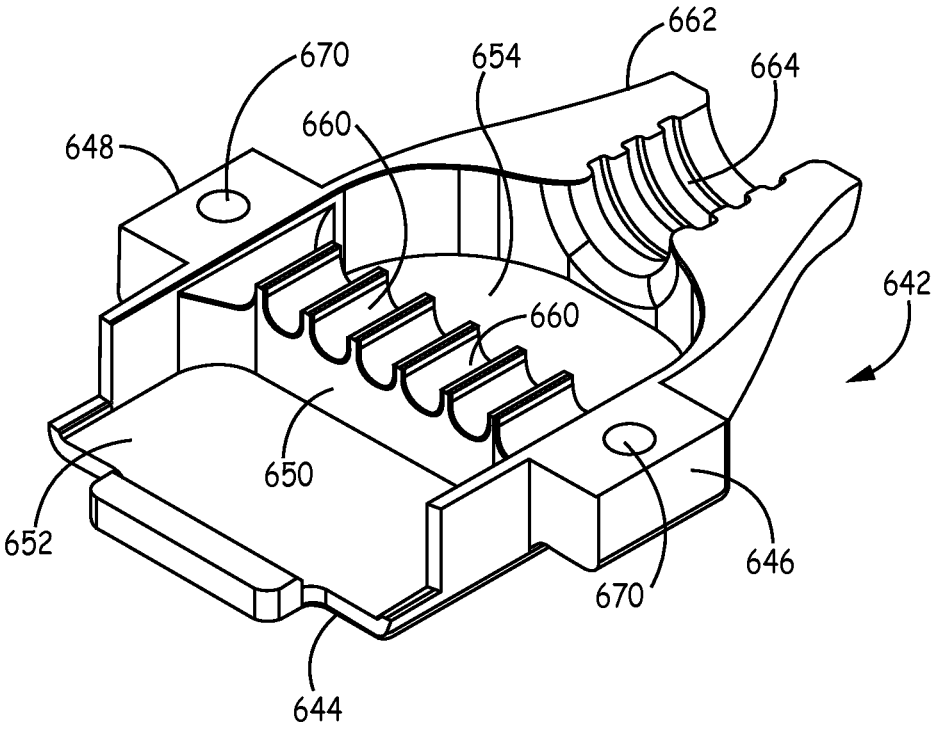
Figure 13:
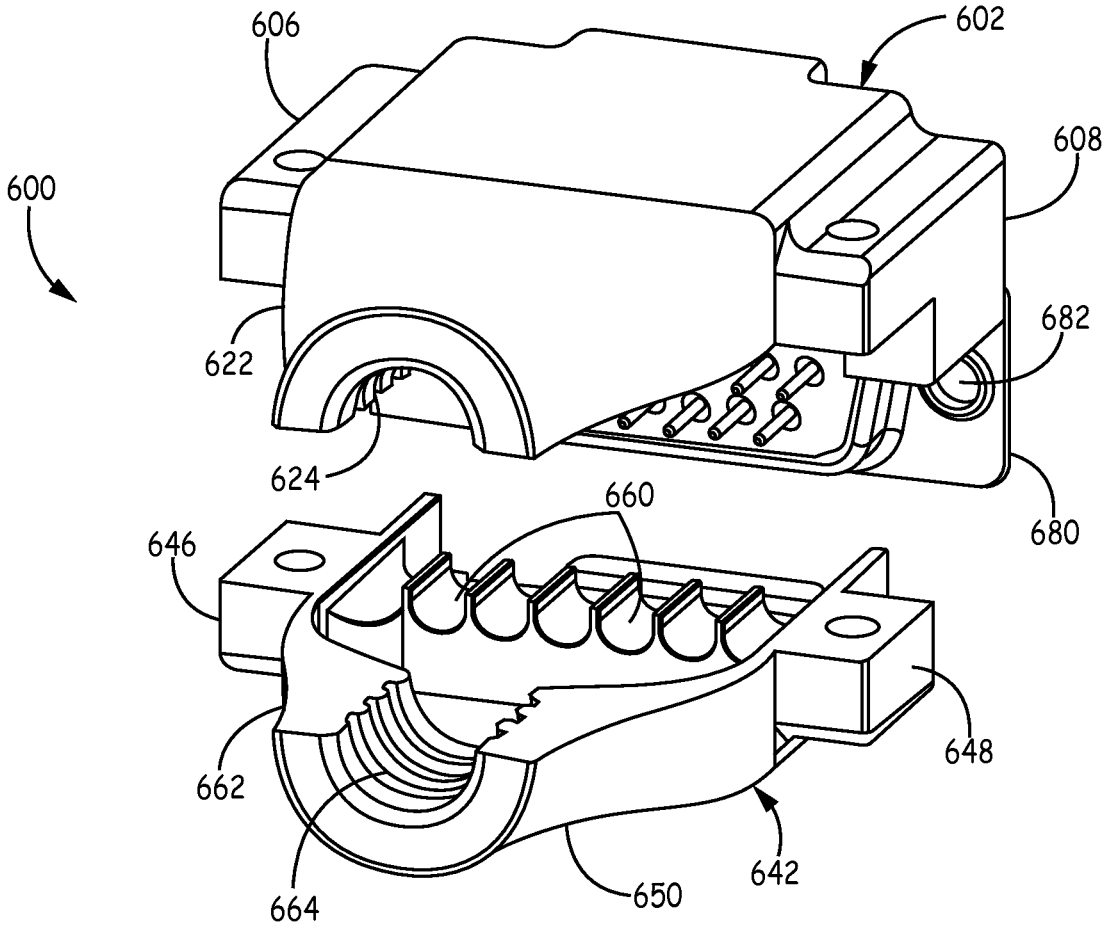

FIGS. 11-13 illustrate the components of a connector backshell assembly 600 according to another embodiment, in which a top shell 602 and a bottom shell 642 are each integrally formed as separate unitary structures prior to being connected together.

As depicted in FIG. 11, top shell 602 includes a base 604, a first sidewall block 606 on one end of base 604, and a second sidewall block 608 on an opposite end of base 604. A shield termination structure 610 extends between sidewall blocks 606, 608, and is located between a front inner surface portion 612 of base 604 and a rear inner surface portion 614 of base 604. The shield termination structure 610 includes a plurality of slots 620 that are substantially parallel to each other, with each of the slots having a U-shaped cross section. A tapered neck section 622 extends from rear inner surface portion 614 and has a channel 624 configured to receive a set of conductors.

As shown in FIG. 12, bottom shell 642 includes a base 644, a first sidewall block 646 on one end of base 644, and a second sidewall block 648 on an opposite end of base 644. A shield termination structure 650 extends between sidewall blocks 646, 648, and is located between a front inner surface portion 652 of base 644 and a rear inner surface portion 654 of base 644. The shield termination structure 650 includes a plurality of slots 660 that are substantially parallel to each other, with each of the slots having a U-shaped cross section. A tapered neck section 662 extends from rear portion 654 and has a channel 664 configured to receive conductors.

The top shell 602 and bottom shell 642 can be connected together with standard fasteners such as screws that are inserted through apertures 630 in top shell 602 (FIG. 11) and apertures 670 in bottom shell 642 (FIG. 12). The top shell 602 and bottom shell 642 can each be fabricated as single unitary structures by standard techniques, such as machining, casting, stamping, plastic molding, or composite processing. The top shell 602 and bottom shell 642 can be composed of various materials, including metals, as well as composites or plastics made conductive by metallic plating processes.

As illustrated in FIG. 13, sidewall block 606 of top shell 602 aligns with sidewall block 646 of bottom shell 642, and sidewall block 608 of top shell 602 aligns with sidewall block 648 of bottom shell 642, when top shell 602 and bottom shell 642 are to be connected together to produce backshell assembly 600. Also, tapered neck sections 622 and 662 are aligned together such that channels 624 and 664 define a rear opening through which conductors can be received. An electrical connector 680, such as a D-subminiature connector, can be connected to top shell 602 with fasteners inserted through apertures 682 in connector 680 and into apertures 632 in top shell 602.

When top shell 602 and bottom shell 642 are connected together, slots 620 in top shell 602 align with respective slots 660 in bottom shell 642 to define a plurality of shield termination pockets each configured to receive a conductor from the rear opening defined by channels 624 and 664. With the wires of the conductors coupled to connector 680, as described for previous embodiments, the exposed shields of the conductors and corresponding conductive grommets around the shields are surrounded by the pockets defined by slots 620 and 660.

Figure 14:
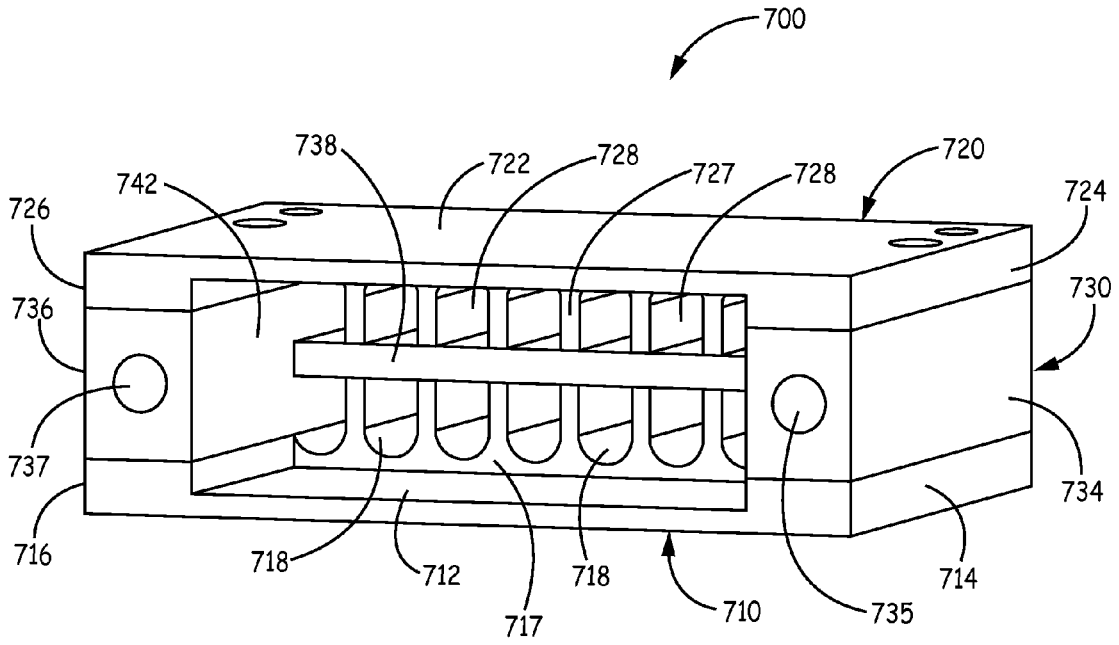
FIG. 14 is an assembled perspective view of a connector backshell assembly according to a further embodiment.
Figure 15:
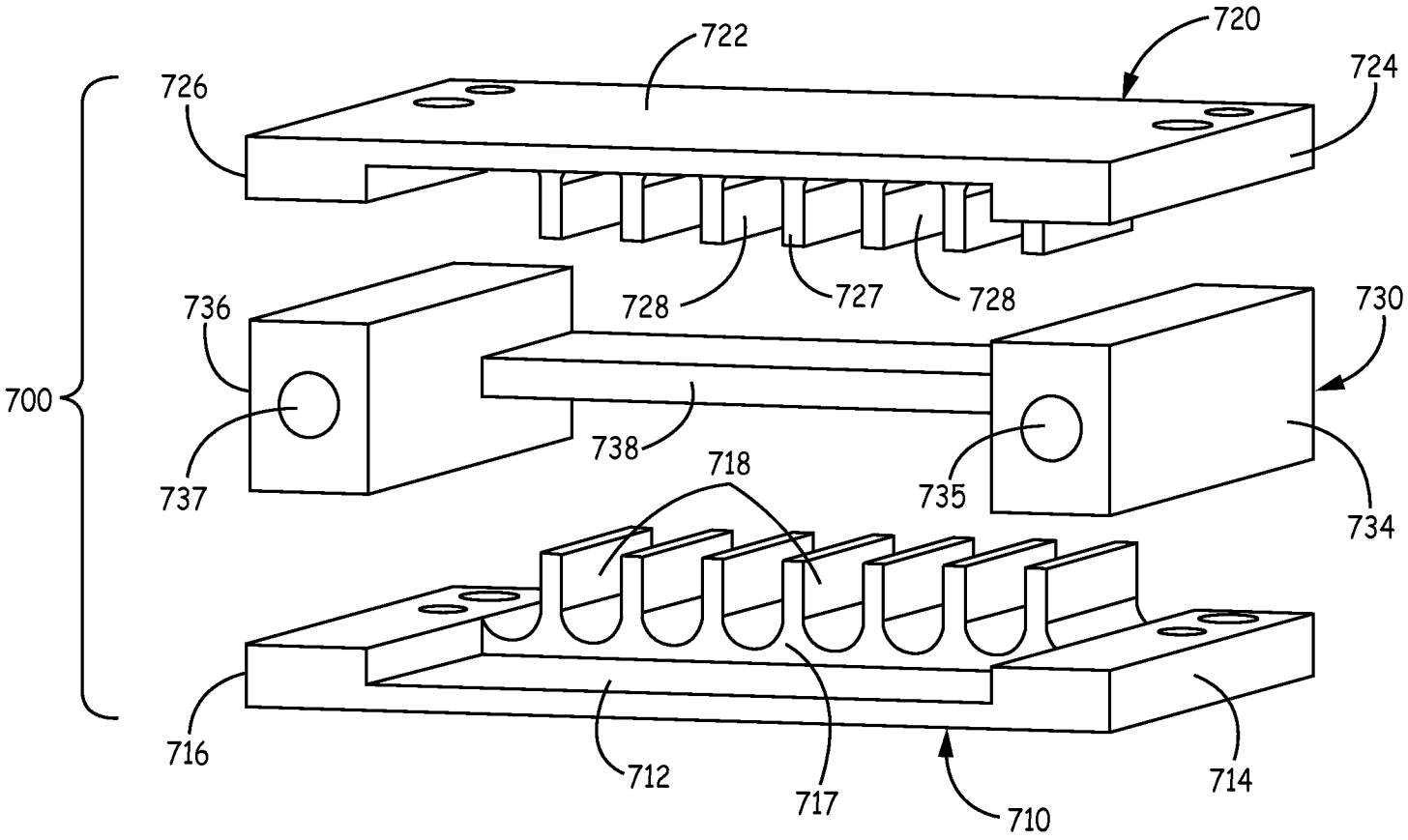
FIG. 15 is an exploded perspective view of the connector backshell assembly of FIG. 14.

FIGS. 14 and 15 illustrate a connector backshell assembly 700 according to another embodiment. The backshell assembly 700 includes a first cover 710 on one side of backshell assembly 700 and a second cover 720 on an opposing side of backshell assembly 700 and space apart from first cover 710. The first and second covers 710 and 720 are separated by a middle support structure 730.

The first cover 710 includes a bottom lid portion 712, a first sidewall portion 714 on one end of lid portion 712, and a second sidewall portion 716 on an opposite end of lid portion 712. A shield termination structure 717 defines a plurality of slots 718 and is located between sidewall portions 714 and 716 along a rear inner surface of lid portion 712. The slots 718 are substantially parallel to each other and sidewall portions 714, 716.

Correspondingly, the second cover 720 includes a top lid portion 722, a first sidewall portion 724 on one end of lid portion 722, and a second sidewall portion 726 on an opposite end of lid portion 722. A second shield termination structure 727 defines a plurality of slots 728 and is located between sidewall portions 724 and 726 along a rear inner surface of lid portion 722. The slots 728 are substantially parallel to each other and sidewall portions 724, 726.

The middle support structure 730 includes a first sidewall block 734 located between sidewall portions 714, 724, and a second sidewall block 736 located between sidewall portions 716, 726. A slot cover section 738 extends between sidewall blocks 734 and 736. A standard electrical connector can be attached to the front of backshell assembly 700 with fasteners inserted into a pair of apertures 735, 737 in middle support structure 730.

As shown in FIG. 14, when covers 710 and 720 are attached to middle support structure 730, backshell assembly 700 has a front opening 742 that is adapted to receive a connector insert. In this embodiment, opposing surfaces of slot cover section 738 are positioned over termination structures 717, 727 such that slots 718, 728 form shield termination pockets, which are configured to receive conductors from the rear of backshell assembly 700 and direct the conductors into front opening 742.

The components of backshell assembly 700 can be fabricated by standard techniques, and can be composed of various conductive materials, such as those described in previous embodiments.

Figure 16:
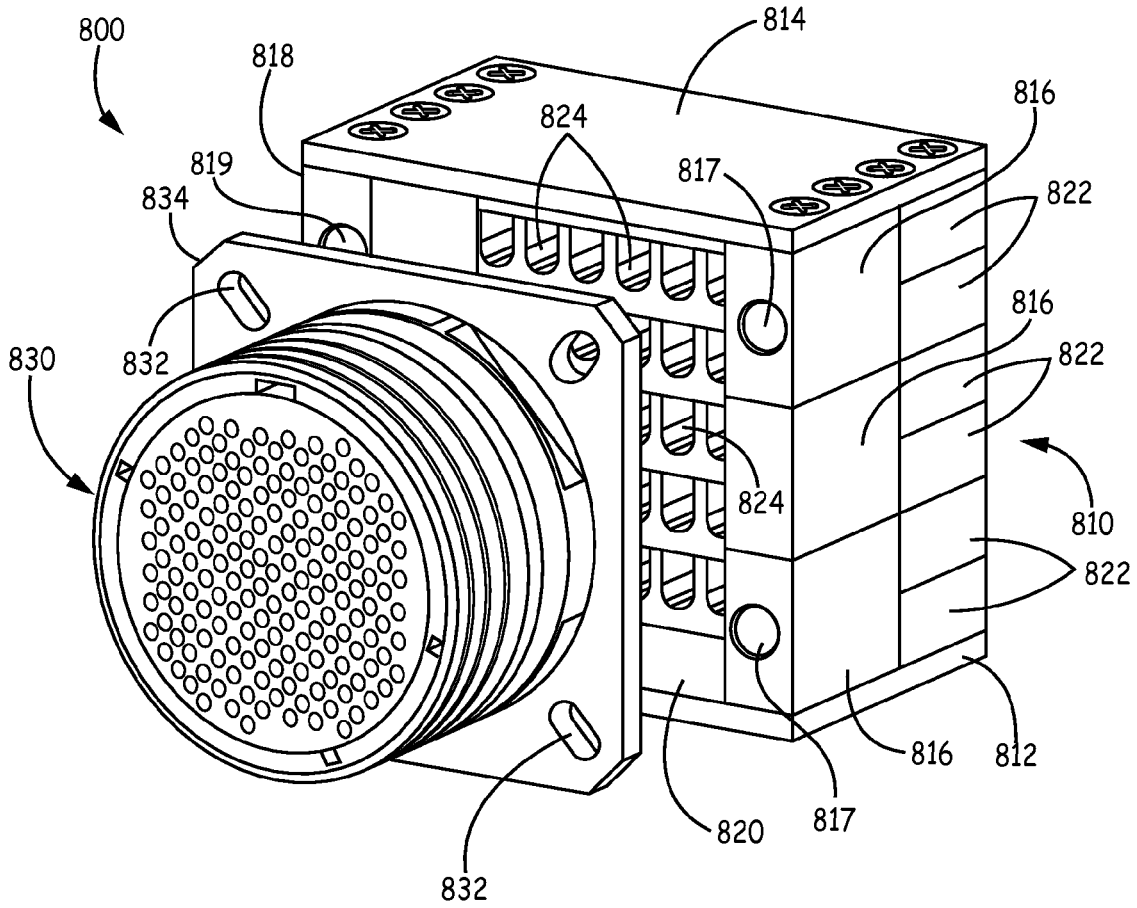
FIG. 16 is a perspective view of a connector termination apparatus according to another embodiment.

FIG. 16 is a perspective view of a connector termination apparatus 800 according to another embodiment, in which a connector backshell assembly 810 is sized and configured to be coupled with a circular electrical connector 830. The backshell assembly 810 includes a first cover such as a bottom lid 812, and a second cover such as a top lid 814. A first stack of sidewall blocks 816 are coupled between bottom lid 812 and top lid 814 at one end. A second stack of sidewall blocks 818 are coupled at an opposite end between bottom lid 812 and top lid 814. The backshell assembly 810 has an opening 820 defined by bottom lid 812, top lid 814, and sidewall blocks 816, 818.

A plurality of stacked shield termination structures 822 are located between bottom lid 812 and top lid 814, and behind sidewall blocks 816 and 818. Each of shield termination structures 820 includes a plurality of slots 824 such as described in previous embodiments. The slots 824 are configured to receive conductors from the rear of backshell assembly 810 and to direct the conductors into opening 820, which is adapted to receive a connector insert from electrical connector 830.

The components of backshell assembly 810 can be fabricated by standard techniques, and can be composed of various conductive materials, such as those described in previous embodiments.

The electrical connector 830 can be connected to the front of backshell assembly 810 with standard fasteners. For example, screws can be inserted through a plurality of apertures 832 in a face plate 834 of connector 830 and coupled with corresponding holes 817, 819 in the front of respective sidewall blocks 816, 818.

EXAMPLE EMBODIMENTS

Example 1 includes a connector backshell assembly, comprising: a first cover; a second cover spaced apart from the first cover; a first sidewall block between the first cover and the second cover; a second sidewall block between the first cover and the second cover, the second sidewall block spaced apart from and facing the first sidewall block; at least one shield termination structure between the first cover and the second cover, the at least one shield termination structure including a plurality of slots that are substantially parallel to each other; wherein the first and second covers, and the first and second sidewall blocks, define a front opening in communication with the slots of the at least one shield termination structure; wherein each of the slots in the at least one shield termination structure are configured to hold a conductor that extends from a rear portion of the backshell assembly into the front opening for termination connection with an electrical connector; wherein the backshell assembly is electrically conductive and provides a shield to prevent electromagnetic interference with each conductor.

Example 2 includes the connector backshell assembly of Example 1, wherein the first cover and the second cover have substantially the same size and shape.

Example 3 includes the connector backshell assembly of any of Examples 1-2, wherein the first cover and the second cover each have a substantially rectangular shape.

Example 4 includes the connector backshell assembly of any of Examples 1-3, wherein the first and second sidewall blocks have substantially the same size and shape.

Example 5 includes the connector backshell assembly of any of Examples 1-4, wherein each of the slots have a U-shaped cross section.

Example 6 includes the connector backshell assembly of any of Examples 1-5, further comprising one or more additional shield termination structures in a stacked configuration with the at least one shield termination structure.

Example 7 includes the connector backshell assembly of any of Examples 1-6, wherein the first and second covers are attached to the first and second sidewall blocks, and to the shield termination structure, with a plurality of fasteners.

Example 8 includes the connector backshell assembly of any of Examples 6-7, wherein the first cover includes a bottom lid portion, a first sidewall portion on one end of the bottom lid portion, and a second sidewall portion on an opposite end of the bottom lid portion.

Example 9 includes the connector backshell assembly of Example 8, wherein a first shield termination structure is located between the first and second sidewall portions along a rear inner surface of the bottom lid portion.

Example 10 includes the connector backshell assembly of any of Examples 8-9, wherein the second cover includes a top lid portion, a first sidewall portion on one end of the top lid portion, and a second sidewall portion on an opposite end of the top lid portion.

Example 11 includes the connector backshell assembly of Example 10, wherein a second shield termination structure is located between the first and second sidewall portions of the top lid portion along a rear inner surface of the top lid portion.

Example 12 includes the connector backshell assembly of Example 11, further comprising a slot cover section extending between the first sidewall block and the second sidewall block, wherein opposing surfaces of the slot cover section are positioned over slots in the first and second shield termination structures to define a plurality of shield termination pockets.

Example 13 includes a method of terminating one or more conductors to a backshell assembly, the method comprising: providing a backshell assembly comprising at least one shield termination structure located between first and second covers, the at least one shield termination structure including a plurality of slots that are substantially parallel to each other; providing one or more conductors each comprising one or more exposed wires at a distal end, an exposed shield spaced apart from the exposed wires, and an outer grommet; inserting each of the one or more conductors through a respective one of the slots in the shield termination structure; coupling each of the one or more exposed wires to an electrical connector attached to the backshell assembly; and positioning the exposed shield of each conductor in the respective slot, with the grommet of each conductor surrounding the exposed shield in the respective slot.

Example 14 includes the method of Example 13, wherein the conductors comprise shielded cables, shielded twisted pairs, or multiconductor cables.

Example 15 includes the method of any of Examples 13-14, wherein the grommet of each conductor comprises a conductive elastomeric material.

Example 16 includes the method of any of Examples 13-15, wherein the electrical connector comprises a D-sub-miniature connector, or a circular connector.

Example 17 includes the method of any of Examples 13-16, wherein the one or more exposed wires are coupled to the electrical connector by crimping each of the wires to a respective contact pin in the electrical connector.

Example 18 includes the method of any of Examples 13-17, further comprising placing a solid conductive filler piece in the slots that are not occupied by a conductor.

Example 19 includes a connector backshell assembly, comprising: a first shell comprising: a first base having a front inner surface portion and a rear inner surface portion; a first sidewall block on one end of the first base; a second sidewall block on an opposite end of the first base; a first shield termination structure that extends between the first and second sidewall blocks, and is located between the front and rear inner surface portions, the first shield termination structure including a plurality of slots that are substantially parallel to each other; and a first tapered neck section that extends from the rear inner surface portion of the first base, the first tapered neck section having a first channel; a second shell removably connected with the first shell, the second shell comprising a second base having a front inner surface portion and a rear inner surface portion; a first sidewall block on one end of the second base; a second sidewall block on an opposite end of the second base; a second shield termination structure that extends between the first and second sidewall blocks of the second base, and is located between the front and rear inner surface portions of the second base, the shield termination structure including a plurality of slots that are substantially parallel to each other; and a second tapered neck section that extends from the rear inner surface portion of the second base, the second tapered neck section having a second channel; wherein each of the slots in the first shield termination structure are aligned with a respective one of the slots in the second shield termination structure to define a plurality of shield termination pockets; wherein the first and second tapered neck sections are aligned together such that the first and second channels define a rear opening in the connector backshell assembly configured to receive one or more conductors.

Example 20 includes the connector backshell assembly of Example 19, wherein each of the slots in the first and second shield termination structures have a U-shaped cross section.

The present invention may be embodied in other specific forms without departing from its essential characteristics. The described embodiments are to be considered in all respects only as illustrative and not restrictive. The scope of the invention is therefore indicated by the appended claims rather than by the foregoing description. All changes that come within the meaning and range of equivalency of the claims are to be embraced within their scope.

What is claimed is:

1. A connector backshell assembly, comprising:

a first cover;

a second cover spaced apart from the first cover;

a first sidewall block between the first cover and the second cover;

a second sidewall block between the first cover and the second cover, the second sidewall block spaced apart from and facing the first sidewall block; and at least one shield termination structure between the first cover and the second cover, the at least one shield termination structure including a plurality of slots that are substantially parallel to each other;

wherein the first and second covers, and the first and second sidewall blocks, define a front opening in communication with the slots of the at least one shield termination structure;

wherein each of the slots in the at least one shield termination structure are configured to hold a conductor that extends from a rear portion of the backshell assembly into the front opening for termination connection with an electrical connector;

wherein the backshell assembly is electrically conductive and provides a shield to prevent electromagnetic interference with each conductor.

2. The connector backshell assembly of claim 1, wherein the first and second sidewall blocks have substantially the same size and shape.

3. The connector backshell assembly of claim 1, wherein each of the slots have a U-shaped cross section.

4. The connector backshell assembly of claim 1, wherein the first and second covers are attached to the first and second sidewall blocks, and to the shield termination structure, with a plurality of fasteners.

5. The connector backshell assembly of claim 1, wherein the first cover and the second cover have substantially the same size and shape.

6. The connector backshell assembly of claim 5, wherein the first cover and the second cover each have a substantially rectangular shape.

7. The connector backshell assembly of claim 1, further comprising one or more additional shield termination structures in a stacked configuration with the at least one shield termination structure.

8. The connector backshell assembly of claim 7, wherein the first cover includes a bottom lid portion, a first sidewall portion on one end of the bottom lid portion, and a second sidewall portion on an opposite end of the bottom lid portion.

9. The connector backshell assembly of claim 8, wherein a first shield termination structure is located between the first and second sidewall portions along a rear inner surface of the bottom lid portion.

10. The connector backshell assembly of claim 9, wherein the second cover includes a top lid portion, a first sidewall portion on one end of the top lid portion, and a second sidewall portion on an opposite end of the top lid portion.

11. The connector backshell assembly of claim 10, wherein a second shield termination structure is located between the first and second sidewall portions of the top lid portion along a rear inner surface of the top lid portion.

12. The connector backshell assembly of claim 11, further comprising a slot cover section extending between the first sidewall block and the second sidewall block, wherein opposing surfaces of the slot cover section are positioned over slots in the first and second shield termination structures to define a plurality of shield termination pockets.

13. A method of terminating one or more conductors to a backshell assembly, the method comprising:

providing a backshell assembly comprising at least one shield termination structure located between first and second covers, the at least one shield termination structure including a plurality of slots that are substantially parallel to each other;

providing one or more conductors each comprising one or more exposed wires at a distal end, an exposed shield spaced apart from the exposed wires, and an outer grommet;

inserting each of the one or more conductors through a respective one of the slots in the shield termination structure;

coupling each of the one or more exposed wires to an electrical connector attached to the backshell assembly; and positioning the exposed shield of each conductor in the respective slot, with the grommet of each conductor surrounding the exposed shield in the respective slot.

14. The method of claim 13, wherein the conductors comprise shielded cables, shielded twisted pairs, or multiconductor cables.

15. The method of claim 13, wherein the grommet of each conductor comprises a conductive elastomeric material.

16. The method of claim 13, wherein the electrical connector comprises a D-subminiature connector, or a circular connector.

17. The method of claim 13, wherein the one or more exposed wires are coupled to the electrical connector by crimping each of the wires to a respective contact pin in the electrical connector.

18. The method of claim 13, further comprising placing a solid conductive filler piece in the slots that are not occupied by a conductor.

19. A connector backshell assembly, comprising:

a first shell comprising:

a first base having a front inner surface portion and a rear inner surface portion;

a first sidewall block on one end of the first base;

a second sidewall block on an opposite end of the first base;

a first shield termination structure that extends between the first and second sidewall blocks, and is located between the front and rear inner surface portions, the first shield termination structure including a plurality of slots that are substantially parallel to each other; and a first tapered neck section that extends from the rear inner surface portion of the first base, the first tapered neck section having a first channel;

a second shell removably connected with the first shell, the second shell comprising a second base having a front inner surface portion and a rear inner surface portion;

a first sidewall block on one end of the second base;

a second sidewall block on an opposite end of the second base;

a second shield termination structure that extends between the first and second sidewall blocks of the second base, and is located between the front and rear inner surface portions of the second base, the shield termination structure including a plurality of slots that are substantially parallel to each other; and a second tapered neck section that extends from the rear inner surface portion of the second base, the second tapered neck section having a second channel;

wherein each of the slots in the first shield termination structure are aligned with a respective one of the slots in the second shield termination structure to define a plurality of shield termination pockets;

wherein the first and second tapered neck sections are aligned together such that the first and second channels define a rear opening in the connector backshell assembly configured to receive one or more conductors.

20. The connector backshell assembly of claim 19, wherein each of the slots in the first and second shield termination structures have a U-shaped cross section.

* * * * *